US008789235B2

(12) United States Patent
Krebs et al.

(10) Patent No.: US 8,789,235 B2
(45) Date of Patent: Jul. 29, 2014

(54) VACUUM CLEANER WITH AGITATOR HEIGHT CONTROL MECHANISM

(75) Inventors: Alan J. Krebs, Pierson, MI (US); Joseph A. Fester, Ada, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 358 days.

(21) Appl. No.: 13/297,778

(22) Filed: Nov. 16, 2011

(65) Prior Publication Data

US 2012/0124769 A1 May 24, 2012

Related U.S. Application Data

(60) Provisional application No. 61/415,178, filed on Nov. 18, 2010.

(51) Int. Cl.
*A47L 9/06* (2006.01)
*A47L 5/00* (2006.01)

(52) U.S. Cl.
USPC ..... 15/368; 15/354; 15/319

(58) Field of Classification Search
CPC ..... A47L 5/34; A47L 5/30; A47L 11/34; A47L 9/0494; A47L 9/06; A47L 5/28; A47L 9/02; A47L 9/009; A47L 11/4069; A47L 11/4041
USPC ..... 15/368, 370, 319, 339, 354, 356, 372, 15/355
See application file for complete search history.

(56) References Cited

U.S. PATENT DOCUMENTS

| | | | | |
|---|---|---|---|---|
| 1,081,340 | A | 12/1913 | Spangler | |
| 1,811,350 | A | 6/1931 | Curry | |
| 2,446,985 | A | 8/1948 | Shumaker | |
| 2,997,729 | A | 8/1961 | Kasper | |
| 3,108,310 | A | 10/1963 | Allen et al. | |
| 4,754,520 | A | 7/1988 | Steadings et al. | |
| 6,123,779 | A | 9/2000 | Conrad et al. | |
| 6,261,379 | B1 | 7/2001 | Conrad et al. | |
| 7,246,407 | B2 * | 7/2007 | Park et al. | 15/354 |
| 7,350,268 | B2 | 4/2008 | Anderson et al. | |
| 7,367,085 | B2 | 5/2008 | Bagwell et al. | |
| 7,653,964 | B2 * | 2/2010 | Kwon et al. | 15/354 |
| 8,132,288 | B2 * | 3/2012 | Dawson et al. | 15/368 |
| 8,214,966 | B2 * | 7/2012 | Steffen et al. | 15/339 |
| 8,424,155 | B2 * | 4/2013 | Hawkins et al. | 15/368 |

FOREIGN PATENT DOCUMENTS

| | | | |
|---|---|---|---|
| CN | 2664578 | Y | 12/2004 |
| EP | 0623304 | A1 | 11/1994 |
| EP | 0793938 | A2 | 9/1997 |
| EP | 1075816 | A2 | 2/2001 |
| FR | 2695023 | A1 | 3/1994 |
| GB | 1343962 | | 1/1974 |
| GB | 1540182 | | 2/1979 |
| WO | 03003931 | A1 | 1/2003 |

* cited by examiner

*Primary Examiner* — Dung Van Nguyen
(74) *Attorney, Agent, or Firm* — McGarry Bair PC

(57) ABSTRACT

A vacuum cleaner includes a base assembly with an upper housing, an agitator mounted in fixed position relative to the upper housing, an agitator height control mechanism for selectively adjusting the vertical height of the agitator relative to the surface to be cleaned, and a sole plate. The sole plate includes a suction nozzle opening for the base assembly and during operation of the agitator height control mechanism, the sole plate moves relative to the upper housing so that the distance between the suction nozzle opening and the surface to be cleaned remains essentially the same, regardless of the position of the agitator.

18 Claims, 10 Drawing Sheets

VACUUM CLEANER WITH AGITATOR HEIGHT CONTROL MECHANISM

CROSS-REFERENCE TO RELATED APPLICATION

This application claims the benefit of U.S. Provisional Application No. 61/415,178, filed Nov. 18, 2010, which is incorporated herein by reference in its entirety.

BACKGROUND OF THE INVENTION

Vacuum cleaners can include an agitator for agitating debris on a surface to be cleaned so that the debris is more easily ingested into the vacuum cleaner. In some cases, the agitator comprises a motor-driven brushroll that rotates within a base assembly or floor nozzle. Agitator height control mechanisms have been developed to allow a user to selectively adjust the height of the agitator relative to the surface to be cleaned to allow in accordance with the type of floor surface, i.e. carpet, deep carpet, bare floor, etc. In many such control mechanisms, the height of the agitator is adjusted by raising or lowering the entire base assembly or floor nozzle relative to the floor surface. This results in a change in the distance between the suction nozzle and the floor surface. As the distance increases, i.e. when the agitator is raised, the working air velocity is decreased and the vacuum cleaner can experience a loss of suction, resulting in reduced efficiency and poorer cleaning performance.

BRIEF DESCRIPTION OF THE INVENTION

A vacuum cleaner according to the invention comprises a base assembly adapted for movement along a surface to be cleaned, and having an upper housing comprising an agitator chamber defined by a first peripheral wall extending around at least a portion of the agitator chamber and a working air conduit adapted to be fluidly interconnected with a suction source, an agitator mounted within the agitator chamber in fixed position relative to the upper housing, an agitator height control mechanism for selectively adjusting the position of the upper housing relative to the surface to be cleaned to thereby adjust the vertical height of the agitator relative to the surface to be cleaned, and a sole plate comprising a suction nozzle opening in register with the agitator chamber and a second peripheral wall in alignment with the first peripheral wall, wherein the sole plate is coupled to the upper housing for movement between at least a first position and a second position, wherein, as the position of the upper housing relative to the surface to be cleaned is adjusted, the sole plate moves between at least the first and second positions. As the sole plate moves between at least the first and second positions, the first and second peripheral walls remain in alignment with one another.

DETAILED DESCRIPTION

The present invention relates generally to agitator height adjustment mechanisms for vacuum cleaners. In one of its aspects, the invention relates to a vacuum cleaner with an agitator height adjustment mechanism utilizing an adjustable sole plate. For purposes of description related to the figures, the terms "upper," "lower," "right," "left," "rear," "front," "vertical," "horizontal," and derivatives thereof shall relate to the invention as oriented in FIG. 1 from the perspective of a user behind the vacuum cleaner, which defines the rear of the vacuum cleaner. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
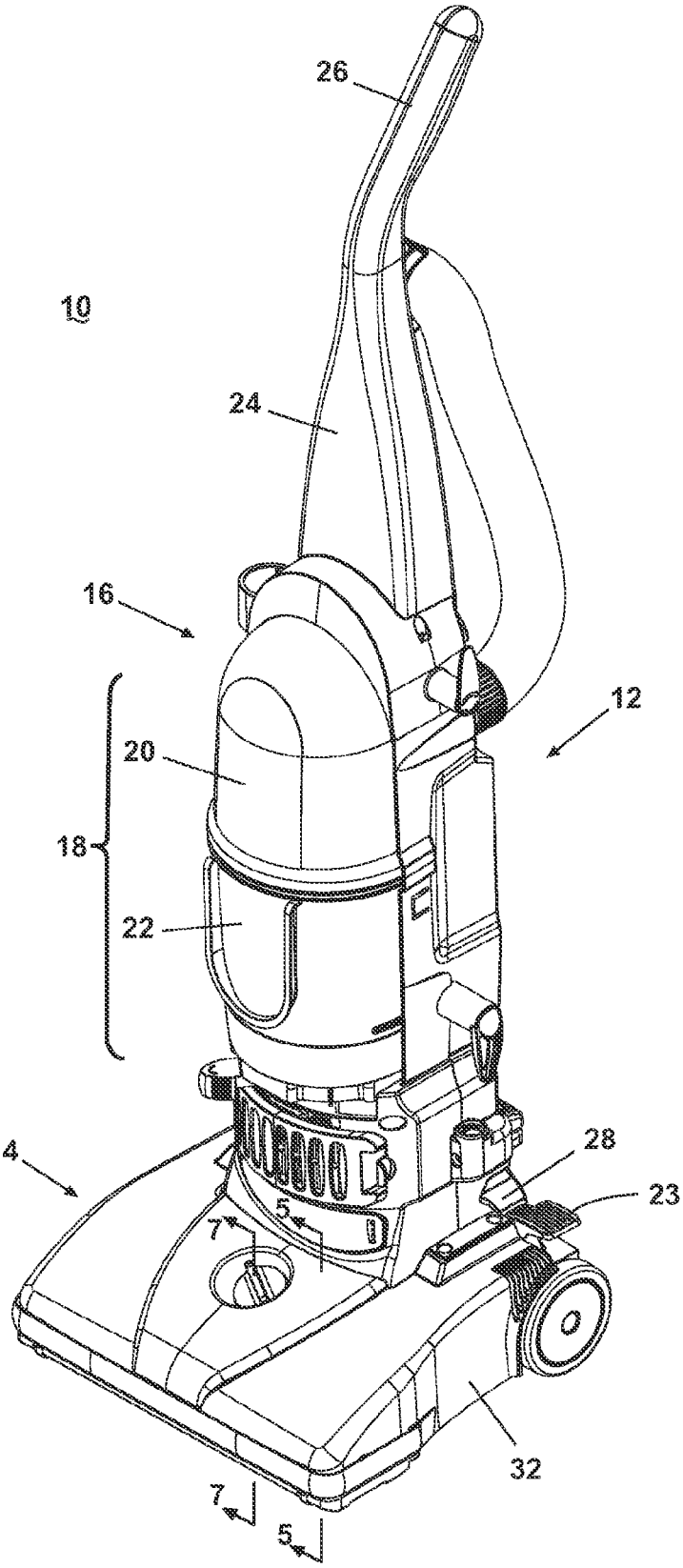
FIG. 1 is a front perspective view of a vacuum cleaner with base assembly pivotally attached to an upright handle assembly, with base assembly having an agitator height control mechanism according to one embodiment of the invention.

FIG. 1 is a perspective view of a vacuum cleaner 10 according to a first embodiment of the invention. As illustrated, the vacuum cleaner 10 comprises an upright handle assembly 12 pivotally mounted to a base assembly 14. The upright handle assembly 12 generally comprises a main body 16 housing a collection system 18 for separating and collecting contaminants from a working airstream for later disposal. In one conventional arrangement illustrated herein, the collection system 18 can include a cyclone separator 20 for separating contaminants from a working airstream and a removable dirt cup 22 for receiving and collecting the separated contaminants from the cyclone separator 20. In another conventional arrangement, the collection system 18 can include an integrally formed cyclone separator and dirt cup, with the dirt cup being provided with a bottom-opening dirt door for contaminant disposal. In yet another conventional arrangement, the collection system 18 can include a filter bag. The vacuum cleaner 10 can also be provided with one or more additional filters upstream or downstream of the collection system 18.

Figure 5:
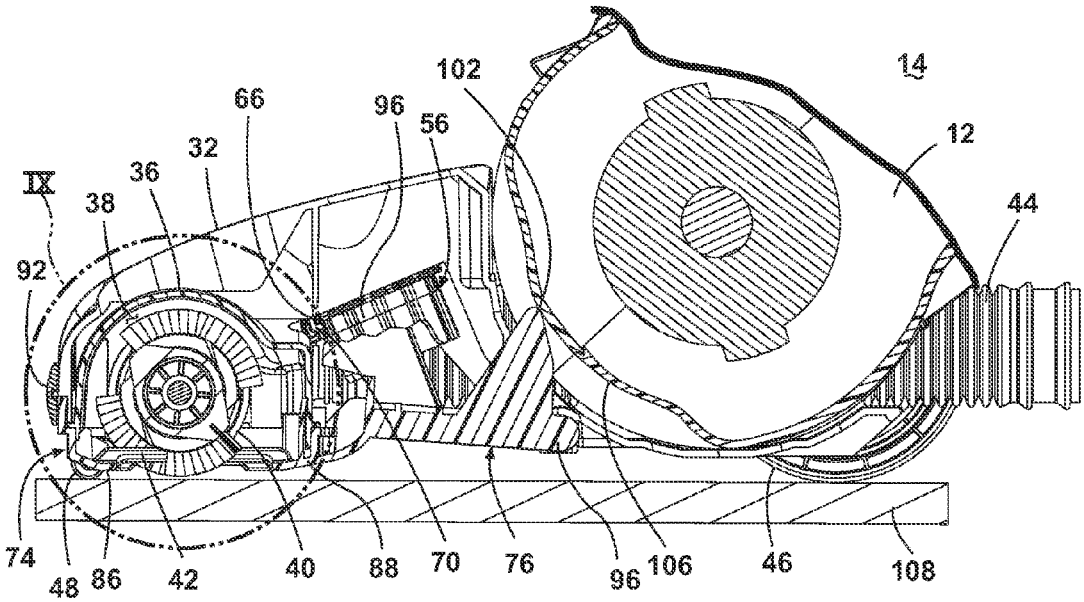
FIG. 5 is a cross-sectional view through line 5-5 of FIG. 1, illustrating the upright handle assembly in a lowered use position and the agitator in a lowered position with respect to a floor surface.

The upright handle assembly 12 is pivotally mounted to the base assembly 14 for movement between an upright storage position (FIGS. 1 and 6) and a reclined use position (FIG. 5). The vacuum cleaner 10 can be provided with a detent pedal 23 pivotally mounted to the base assembly 14 for selectively releasing the upright handle assembly 12 from the storage position to the use position. The details of such a detent pedal 23 are commonly known in the art, and will not be discussed in further detail herein.

The main body 16 also has an upwardly extending handle 24 that is provided with a hand grip 26 at one end that can be used for maneuvering the vacuum cleaner 10 over a surface to be cleaned. A motor cavity 28 is formed at a lower end of the main body 16 and contains a conventional suction source (not shown), such as a motor/fan assembly, positioned therein in fluid communication with the collection system 18. In operation, the vacuum cleaner 10 draws in dirt-laden air through the base assembly 14 and into the collection system 18 where the dirt is substantially separated from the working air. The air flow then passes through the motor cavity 28 and past the suction source prior to being exhausted from the vacuum cleaner 10. A suitable upright handle assembly 12 is more fully described in detail in U.S. Pat. No. 7,708,789 to Fester, which is incorporated herein by reference in its entirety.

Figure 2:
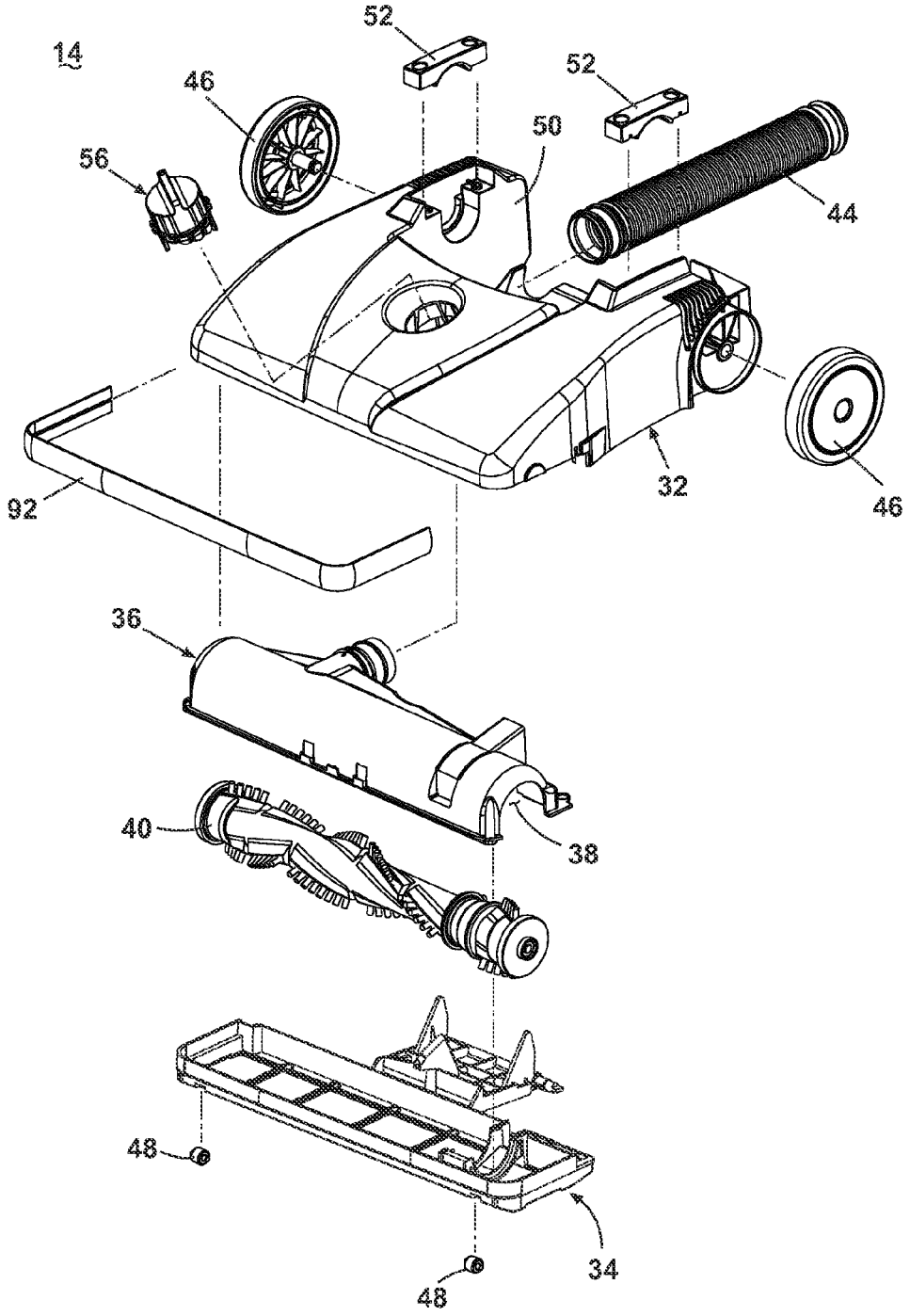
FIG. 2 is an exploded view of the base assembly from FIG. 1, illustrating the agitator height control mechanism.

FIG. 2 is an exploded view of the base assembly 14 from FIG. 1. The base assembly 14 includes an upper housing 32 that couples with a lower housing 34 to create a partially enclosed space therebetween. As illustrated herein, the lower housing 34 can comprise a sole plate for the vacuum cleaner 10, and is referred to as sole plate 34 herein. An agitator casing 36 is positioned within the upper housing 32 and mates with a portion of the sole plate 34 to create an agitator chamber 38 at a forward portion of the upper housing 32. An agitator 40 is positioned within the agitator chamber 38 for rotational movement, and can be coupled to the motor/fan assembly in the motor cavity 28 (FIG. 1) via a commonly known arrangement including a drive belt (not shown). Alternatively, a dedicated agitator motor can be provided in the base assembly 14 for driving the agitator 40. The agitator 40 is illustrated as a brushroll rotatable about a horizontal axis; however, it is within the scope of the invention for other types of agitators to be used, such as a stationary brush, dual rotating brushrolls, or at least one brush that is rotatably mounted about a vertical axis.

A suction nozzle opening 42 is formed in the sole plate 34 in fluid communication with the agitator chamber 38. A duct 44 is coupled at one end to the agitator casing 36 and fluidly communicates the suction nozzle opening 42 with the collection system 18 (FIG. 1). A pair of rear wheels 46 is provided on the upper housing 32 and a pair of front wheels 48 is provided on the sole plate 34 for maneuvering the vacuum cleaner 10 over a surface to be cleaned. The upper housing 32 further includes a rear cavity 50 for receiving the motor cavity 28 of the upright handle assembly 12. A pair of clamps 52 pivotally secures the upright handle assembly 12 to the upper housing 32.

Figure 3:
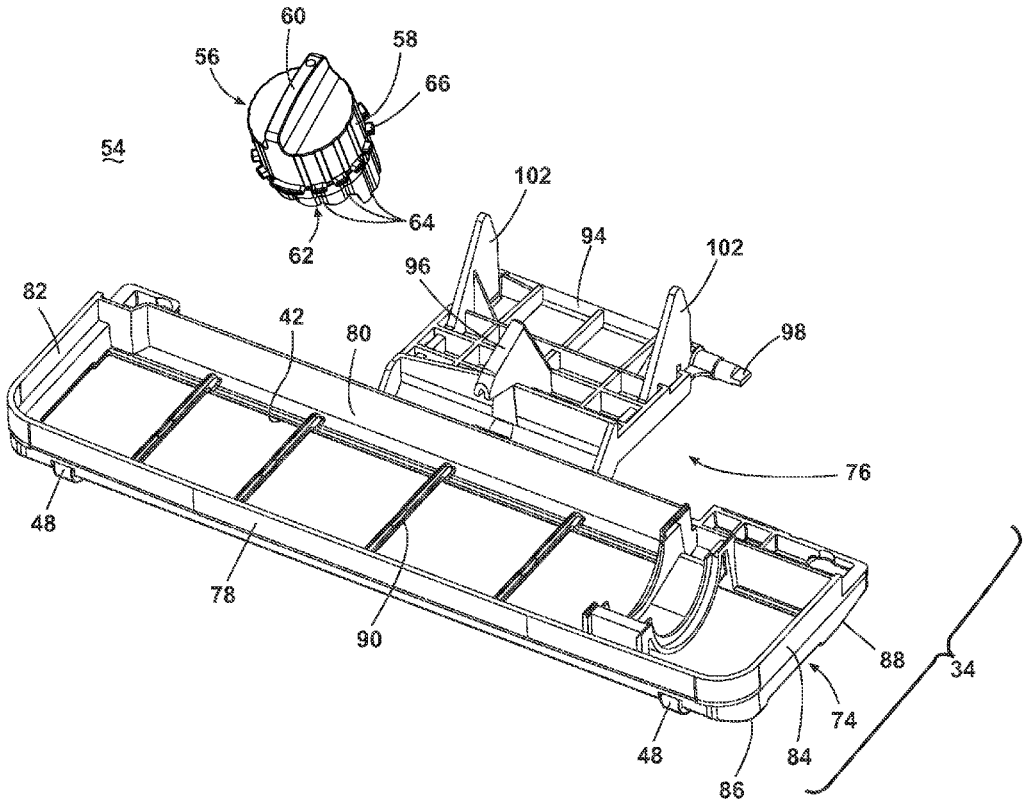
FIG. 3 is an exploded view of the agitator height control mechanism from FIG. 2.

Referring additionally to FIG. 3, the base assembly 14 further comprises an agitator height control mechanism 54 for selectively adjusting the vertical height of the agitator 40 relative to the surface to be cleaned. The control mechanism 54 can be used to engage or disengage the agitator 40 with or from the surface to be cleaned. As will be described below, the control mechanism 54 adjusts the position of the upper housing 32 and agitator casing 36 relative to the sole plate 34, which, by virtue of the agitator 40 being mounted within the agitator casing 36, results in an adjustment of the position of the agitator 40 relative to the suction nozzle opening 42. The sole plate 34 remains stationary throughout the adjustment such that the distance between the suction nozzle opening 42 and the surface to be cleaned is the same regardless of the position of the agitator 40.

The control mechanism 54 comprises the sole plate 34 and an actuator 56 that engages the sole plate 34 that is operated by a user. Referring to FIG. 3, the actuator 56 can comprise a rotatable height adjustment knob that comprises a cylindrical body 58 having a handle or grip 60 on an upper surface thereof and a cam portion 62 on the lower edge thereof. The cam portion 62 is illustrated as including a number of incremental steps 64, where each adjacent step 64 has a constant or variable height differential. The body 58 further includes a peripheral flange 66 between the grip 60 and the cam portion 62 and, as illustrated, can be formed by one or more discontinuous portions encircling the body 58.

Figure 4:
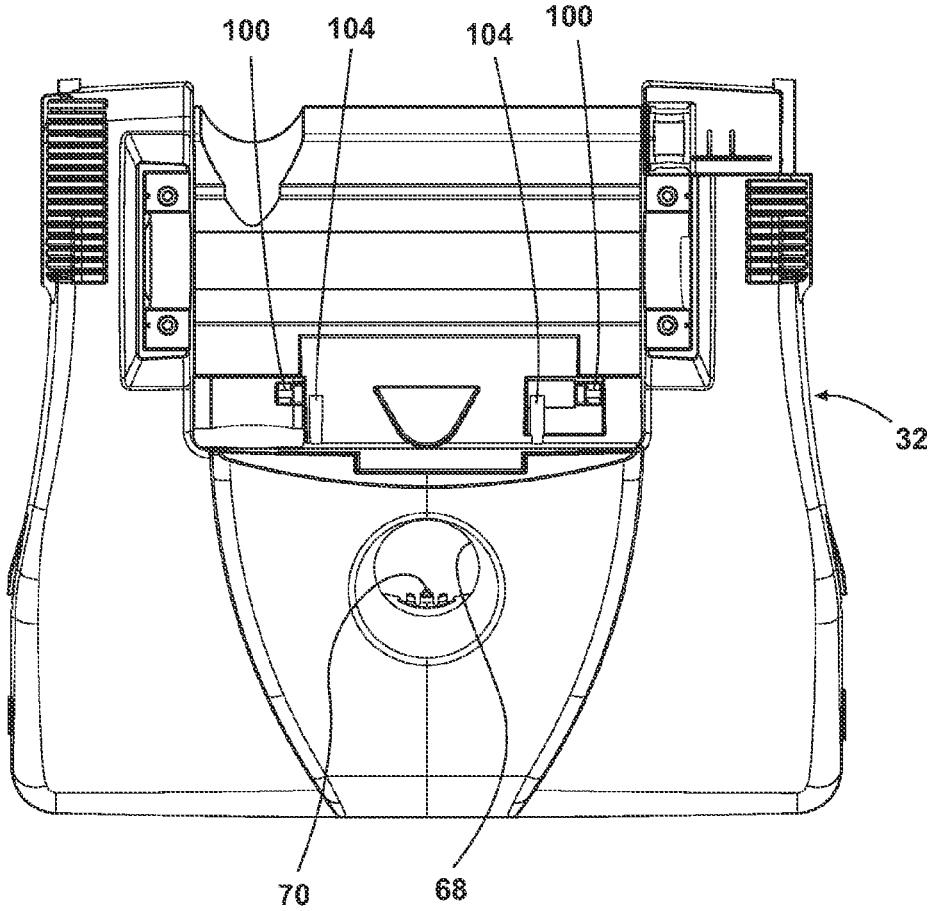
FIG. 4 is a top plan view of an upper housing of the base assembly from FIG. 2.

Referring additionally to FIG. 4, which is a top plan view of the upper housing 32, the housing 32 includes an opening 68 in an upper surface thereof for receiving the actuator 56 and a support feature 70 adjacent the opening 68. As illustrated herein, the support feature 70 includes one or more L-shaped projections (see FIG. 7). When assembled, the actuator 56 is supported within the opening 68 by the flange 66 resting on the L-shaped projections forming the support feature 70 and the grip 60 is accessible to the user on the exterior of the base assembly 14.

The sole plate 34 comprises a front portion in the form of a suction inlet 74 that defines the suction nozzle opening 42 and a rear portion in the form of a carriage assembly 76 that interacts with the actuator 56. The suction inlet 74 comprises a front wall 78 and a rear wall 80 joined by a pair of side walls 82, 84 which together form a sleeve-like inlet that is slidingly received by the agitator casing 36. The suction inlet 74 further includes a bottom leading wall 86 joined to the lower end of the front wall 78 and a bottom trailing wall 88 joined at the lower end of the rear wall 80. The leading and trailing walls 86, 88 can have a slight curvature and/or angle for the sole plate 34 to glide over the surface to be cleaned. As illustrated, both the leading and trailing walls 86, 88 curve downwardly toward the suction nozzle opening 42 (see FIG. 7). The front wheels 48 are coupled to the leading wall 86 of the suction inlet 74. The suction inlet 74 can further include one or more cross-pieces 90 extending between the leading and trailing walls 86, 88 that intersect the suction nozzle opening 42 to enhance structural rigidity and to prevent large items from being ingested into the vacuum cleaner 10. As shown in FIG. 2, a bumper 92 can be provided on the leading end of the upper housing 32, and can be attached to at least a portion of the front and side edges of the upper housing 32. As illustrated, the bumper 92 extends along the entire front edge and along a portion of the side edges of the upper housing 32. Alternatively, the bumper 92 can be secured to a portion of the sole plate 34, such as the front and side walls 78, 82, 84.

The carriage assembly 76 comprises a carriage body 94 that extends rearwardly from the rear wall 80 of the suction inlet 74. The carriage body 94 includes a cam follower 96 that extends upwardly at an angle from the upper surface of the carriage body 94 and engages the cam portion 62 on the actuator 56. The carriage body 94 further includes a pair of opposing pivot axles 98 formed at a rear portion of the carriage body 94 and that are received by pivot connectors 100 on the underside of the housing 32 to pivotally mount the carriage assembly 76 to the housing 32 (FIG. 4). The pivot axles 98 define the movement axis of the sole plate 34.

The control mechanism 54 also functions to automatically disengage the agitator 40 from the floor surface, regardless of the setting of the actuator 56, when the upright handle assembly 12 is moved to the storage position (FIG. 1). One or more projections 102 extend upwardly from the upper surface of the carriage body 94. As illustrated, a pair of spaced projections 102 is provided rearwardly of the cam follower 96, each of which is sliding received by a corresponding pair of slots 104 on the housing 32.

Figure 6:
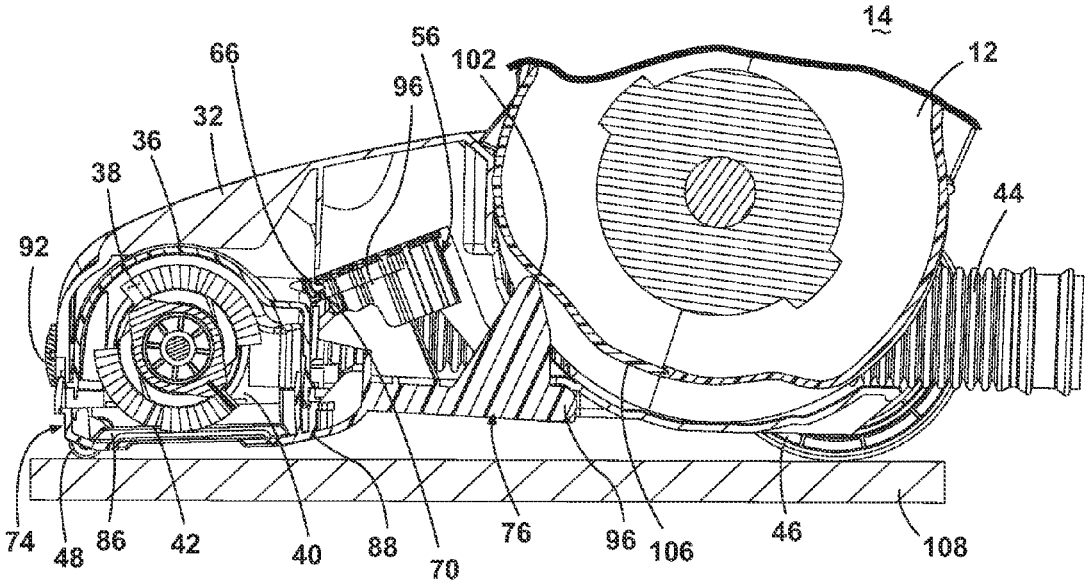
FIG. 6 is a cross-sectional view similar to FIG. 5, illustrating the upright handle assembly in an upright storage position and the agitator in a raised position with respect to a floor surface.

FIGS. 5 and 6 are cross-sectional views through line 5-5 of FIG. 1, illustrating the upright handle assembly 12 in the lowered use position and the upright storage position, respectively. The projections 102 are configured to selectively engage a lower surface of the main body 16 when the upright handle assembly is placed in the upright storage position. As illustrated, the lower surface of the main body 16 can be provided with a pair of cammed surfaces 106, only one of which is shown in FIGS. 5-6, which the projections 102 travel along. When the upright handle assembly 12 is reclined to the use position, as shown in FIG. 5, the cammed surfaces 106 are disengaged from the projections 102 and the sole plate 34 is free to pivot upwardly about the pivot axles 98 until the cam follower 96 engages the cam portion 62 of the actuator 56. When the upright handle assembly 12 is returned to the storage position, as shown in FIG. 6, the cammed surfaces 106 on the lower surface of the main body 16 push the projections 102 downwardly, which rotates the sole plate 34 about the pivot axles 98 and forces the suction inlet 74 downwardly, overriding the setting of the actuator 56 and pushing the sole plate 34 to its lowermost position. This ensures that the agitator 40 will be spaced away from the floor surface 108 when the upright handle assembly 12 is in the storage position. This feature is useful when the vacuum cleaner 10 is provided with a single motor acting as both the suction source and the agitator driver, because the agitator 40 will continue to spin if the motor/fan assembly remains on while handle assembly 12 is in the storage position, such as when a user performs above-the-floor cleaning.

Figure 7:
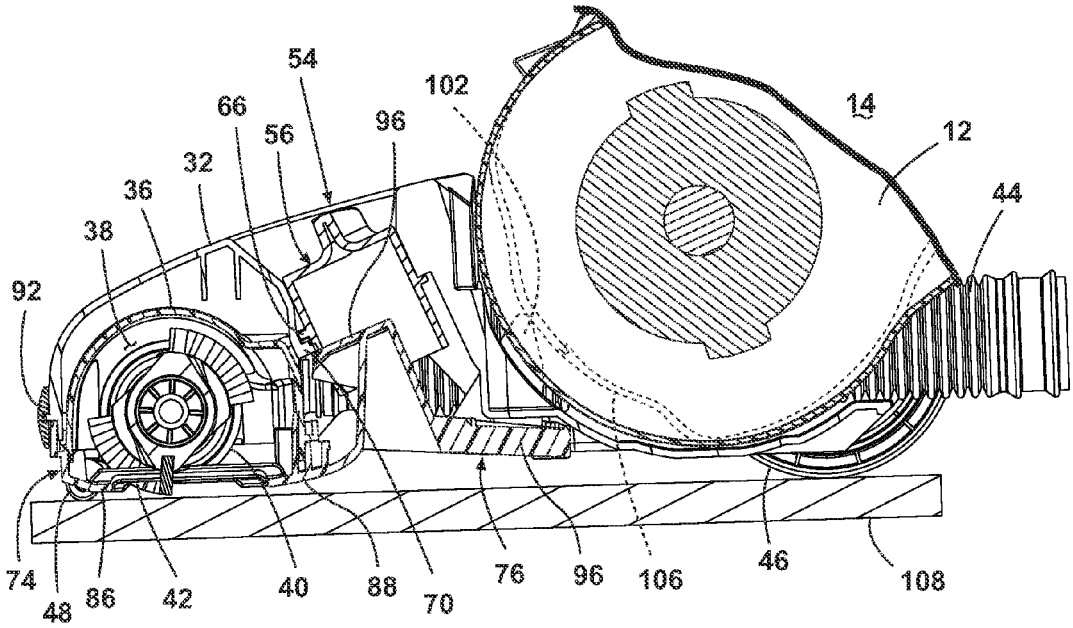
FIG. 7 is a cross-sectional view through line 7-7 of FIG. 1, illustrating the agitator in a lowered position with respect to a floor surface.
Figure 8:
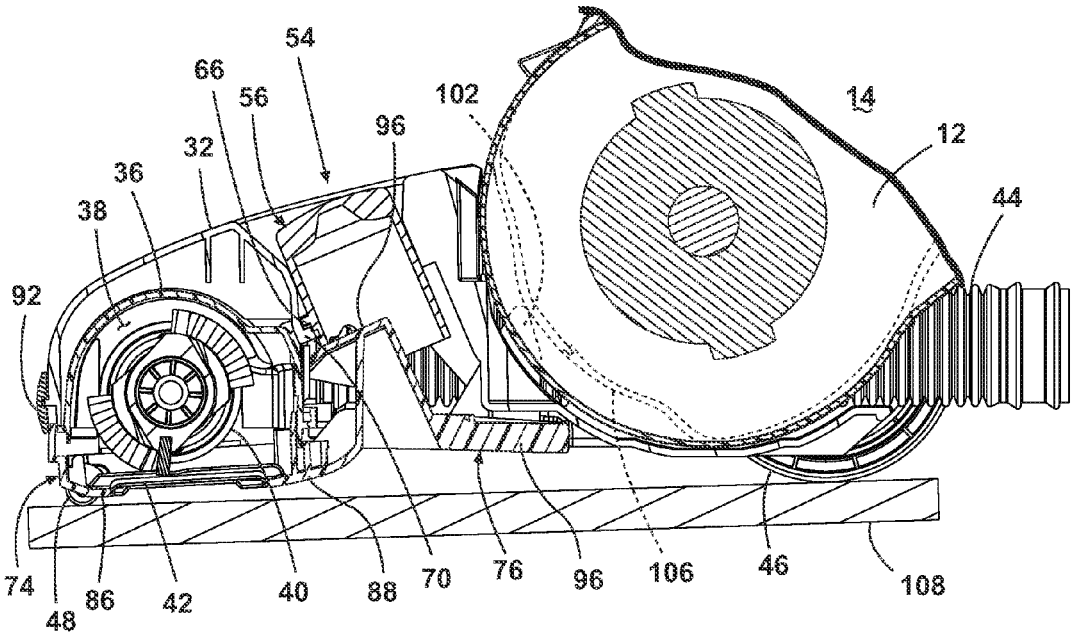
FIG. 8 is a cross-sectional view similar to FIG. 7, illustrating the agitator in a raised position with respect to a floor surface.

FIGS. 7 and 8 are cross-sectional views through line 7-7 of FIG. 1, illustrating the agitator 40 in a lowered position and a raised position, respectively, with respect to a floor surface 108. Also, the upright handle assembly 12 is illustrated in the lowered use position in both FIGS. 7 and 8. In the lowered position of FIG. 7, the agitator 40 is fully engaged with the floor surface 108. In the raised position of FIG. 8, the agitator 40 is fully raised or disengaged from the floor surface 108. The engagement of the agitator 40 with the floor surface 108 can be adjusted by rotating the actuator 56 in a clockwise or counterclockwise direction. As the actuator 56 is rotated, the cam follower 96 riding along the cam portion 62 on the actuator 56 moves between the incremental steps 64 of the cam portion 62, which adjusts the vertical position of the suction inlet 74 on the sole plate 34 relative to the upper housing 32. The pivot axles 98 act as a fulcrum about which the upper housing 32 moves. The front wheels 48 of the sole plate 34 will continue to rest on the floor surface 108 while the upper housing 32 is lifted or lowered because the sole plate 34 is pivotally mounted to the upper housing 32 and is urged against the floor surface 108 by the control mechanism 54. The suction nozzle opening 42 therefore remains essentially parallel with the floor surface 108. Since the vertical position of the agitator 40 is fixed relative to the upper housing 32, the height of the agitator 40 is adjusted up or down, depending on the direction of actuator rotation, from a fully lowered position shown in FIG. 7 where the agitator 40 is close to the floor surface 108 to a fully raised position shown in FIG. 8 where the agitator 40 is further from the floor surface 108. While only two agitator positions are illustrated herein, it is understood that any number of discrete agitator positions are possible, and are dependent on the number of incremental steps 64 provided on the actuator 56.

Indicia corresponding to the agitator height setting to use for each type of floor surface can be provided on the upper housing 32. For example, the lowest height setting, i.e. whereby the agitator 40 is closest to the floor surface 108, can be associated with low carpet piles, higher height settings, i.e. whereby the agitator 40 is further from the floor surface 108, can be associated with increasingly deep or plush carpet piles, and the highest height setting, i.e. where the agitator 40 is completely disengaged form the floor surface 108, can be associated with bare floors.

In the raised and lowered positions, the vertical position of the sole plate 34 does not change, and the distance between the floor surface 108 and the suction nozzle inlet 42 remains constant. The primary change is in the position of the suction inlet 74 relative to the upper housing 32 or agitator 40. As such, there is no loss of suction when adjusting the amount of engagement between the agitator 40 and the floor surface 108. This also allows proper suction to be maintained at the suction nozzle inlet 42, even if the agitator engagement setting is not set to the optimal position for the specific type of floor surface 108.

Figure 9:
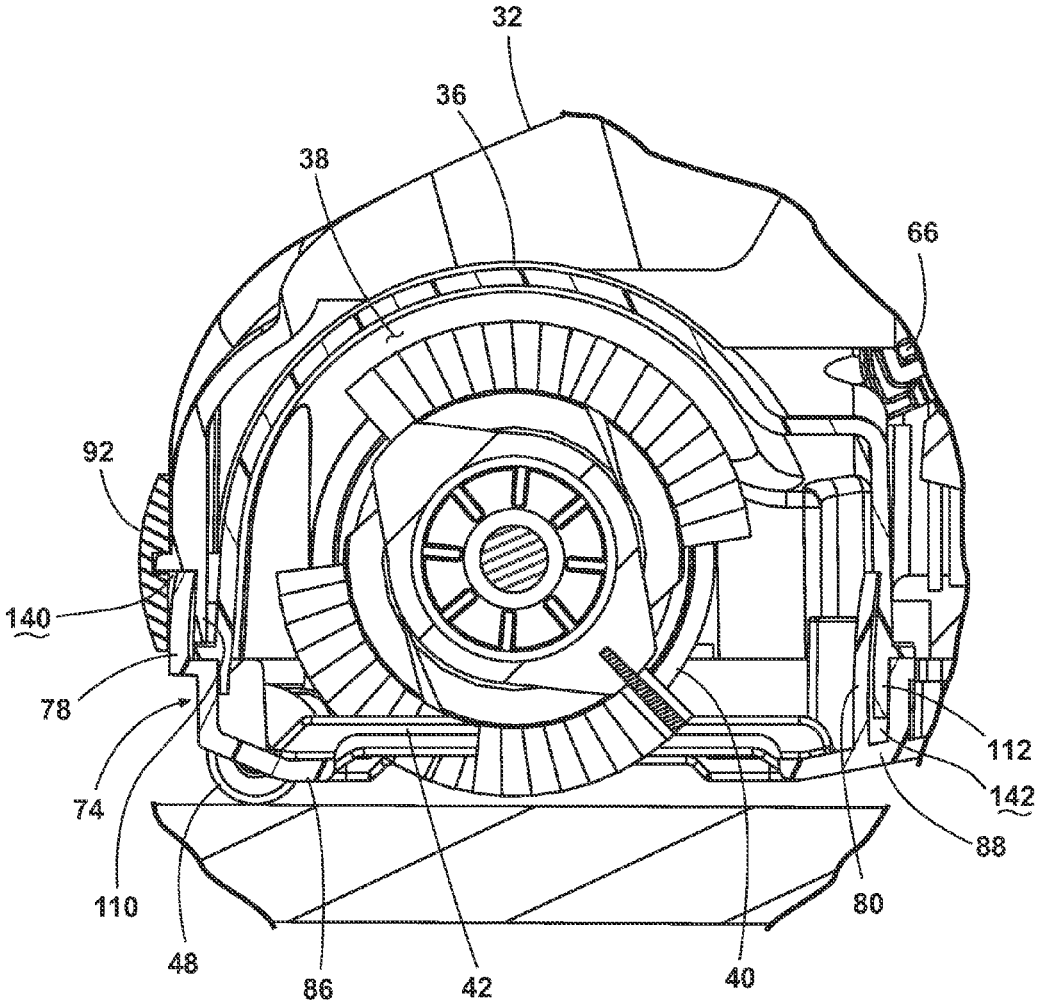
FIG. 9 is a close-up view of section IX of FIG. 5.

FIG. 9 is a close-up view of section IX of FIG. 5, which illustrates that the front and rear walls 78, 80 of the suction inlet 74 on the sole plate 34 can be curved or slightly arcuate. Additionally, corresponding front and rear walls 110, 112 of the agitator casing 36 can have a complementary curve. The front wall 78 of the suction inlet 74 slides relative to the front wall 110 of the agitator casing 36 as the vertical height of the agitator 40 is selectively adjusted. Likewise, the rear wall 80 of the suction inlet 74 slides relative to the rear wall 112 of the agitator casing 36 as the vertical height of the agitator 40 is selectively adjusted. The curvature of the walls 78, 110 and 80, 112 minimize air leakage between the sole plate 34 and the upper housing 32 as the sole plate 34 slides up and down relative to the upper housing 32, thereby preventing any loss of suction at the suction inlet 74. Furthermore, as can be seen in FIG. 9, one or more walls 78-84 of the sole plate 34 can be received in a recess on the upper housing 32 to help minimize air leakage by creating a labyrinth-like passage at the interface between the sole plate 34 and the upper housing 32. The inverse can also be the case, i.e. one or more walls of the upper housing 32 or agitator casing 36 can be received in a recess on the sole plate 34. As shown, the front wall 78 of the sole plate 34 is received within a recess 140 formed between the bumper 92 and the front wall 110 of the agitator casing 36. The rear wall 112 of the agitator casing 36 is received within a recess 142 formed in the sole plate 34 behind the rear wall 80.

Figure 10:
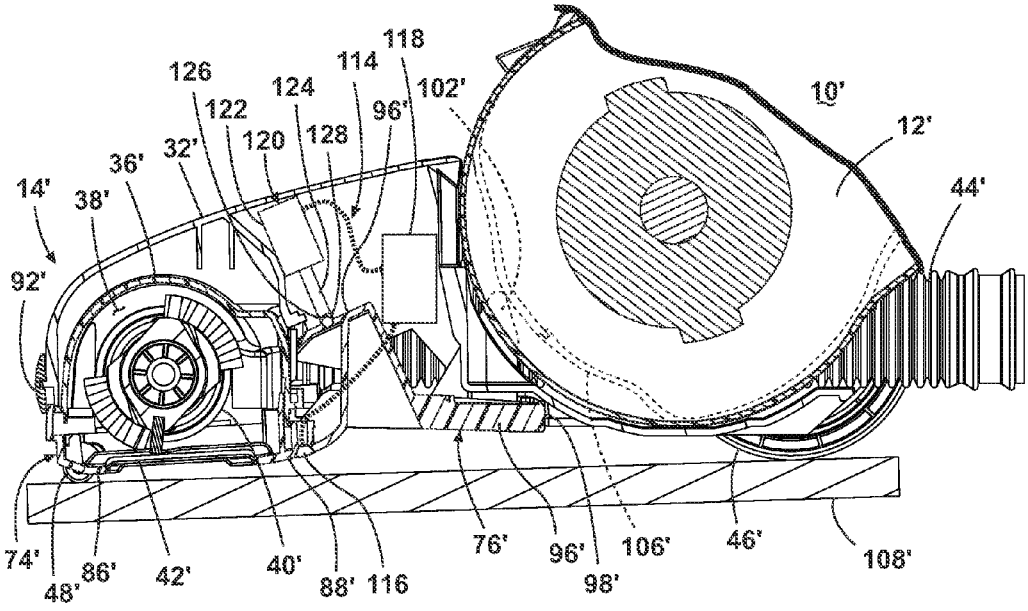
FIG. 10 is a schematic view of a base assembly of a vacuum cleaner according to a second embodiment of the invention.

FIG. 10 is a schematic view of a base assembly 14' of a vacuum cleaner 10' according to a second embodiment of the invention, where features in common with the first embodiment shown in FIGS. 1-9 are indicated with the same reference numeral bearing a prime (') symbol. The second embodiment differs from the first embodiment in that an electrical agitator height control mechanism 114 is used to move the sole plate 34' in place of the mechanical agitator height control mechanism 54 of the first embodiment. The control mechanism 114 comprises the sole plate 34' and an actuator that engages the sole plate 34' that is automatically operated without input from the user. The control mechanism 114 further comprises a floor condition sensor 116 that can be provided on the base assembly 14' for detecting the type of floor surface 108' below the base assembly 14', such as carpet, including different carpet pile heights, or bare floor. The control mechanism 114 can adjust the position of the sole plate 34' relative to the upper housing 32' based on input from the floor condition sensor 116. The floor condition sensor 116 can comprise any one or combination of known sensor devices, such as, for example, an ultrasonic transducer, optical, acoustic, or mechanical sensor. Some examples of suitable floor condition sensors are disclosed in U.S. Pat. No. 4,977,639 to Takahashi et al. and U.S. Pat. No. 5,105,502 to Takashima, which are incorporated herein by reference herein in their entirety.

The actuator of the control mechanism 114 may be defined by a controller 118 mounted in the upper housing 32' that is electrically connected to the floor condition sensor 116 and an electromechanical solenoid piston assembly 120. The controller 118 can comprise a conventional printed circuit board assembly as is commonly known in the art. The piston assembly 120 can be fixedly mounted within the upper housing 32' and comprises a piston housing 122 and a movable piston rod 124 that is adapted to reciprocate between extended and retracted positions relative to the piston housing 122 in response to control signals received from the controller 118. A leading end 126 of the rod 124 is linked to the cam follower 96' via a pin joint 128. Accordingly, because the leading end 126 of the rod 124 is linked to the cam follower 96', reciprocating linear movement of the rod 124 pulls and pushes the cam follower 96', thereby pivoting the sole plate 34' upwardly and downwardly about its pivot axles 98'. Alternatively, the piston assembly 120 can be replaced by another mechanism such as a motor-driven cam or gear drive configuration, one example of which is disclosed in U.S. Pat. No. 4,706,327 to Getz et al., which is incorporated herein by reference herein in its entirety.

The controller 118 can be configured to determine the floor type and the corresponding optimal sole plate 34' height setting by comparing input signals from the floor condition sensor 116 to a pre-programmed value set. The controller 118 can further be configured to emit corresponding output signals to discretely control the extension or retraction of the piston rod 124 at pre-determined settings, which adjusts the sole plate 34' height to accommodate various floor types. The floor condition sensor 116, controller 118, and piston assembly 120 are electrically connected in series with the suction source (not shown) and are energized when the vacuum cleaner 10' is connected to a power source and turned "ON."

In operation, a user prepares the vacuum cleaner 10' for use by connecting it to a power source and actuating a power switch (not shown). As a user pushes the vacuum cleaner 10', the floor condition sensor 116 senses various properties of the floor surface 108' and provides input signals to the controller 118. The controller 118 processes those signals and determines the floor type by comparing incoming data values to a pre-determined value set. The controller 118 then emits an output signal to the piston assembly 120, which controls the position of the piston rod 124 relative to the piston housing 122. For example, when the vacuum cleaner 10' encounters a bare floor surface such as hardwood or tile flooring, the controller 118 extends the piston rod 124. As the leading end 126 of the piston rod 124 extends outwardly, the pin joint 128 transmits the linear movement of the piston rod 124 to the cam follower 96'. Accordingly, the extending piston rod 124 pushes the cam follower 96' and pivots the sole plate 34' downwardly, thus raising the upper housing 32' and agitator 40' away from the suction nozzle inlet 42' and bare floor surface 108'. Conversely, when the vacuum cleaner 10' encounters a medium pile carpet, the controller 118 retracts the piston rod 124. As the piston rod 124 retracts, the pin joint 128 pulls the cam follower 96' and pivots the sole plate 34' upwardly about its pivot axles 98', thus lowering the upper housing 32' and agitator 40' towards the suction nozzle inlet 42' and floor surface 108', whereupon the agitator 40' engages the floor surface 108'. Accordingly, the controller 118 adjusts the sole plate 34' position relative to the upper housing 32' to achieve the optimal agitator engagement for various floor surfaces. The suction nozzle opening 42' therefore remains essentially parallel with the floor surface 108'.

Figure 11:
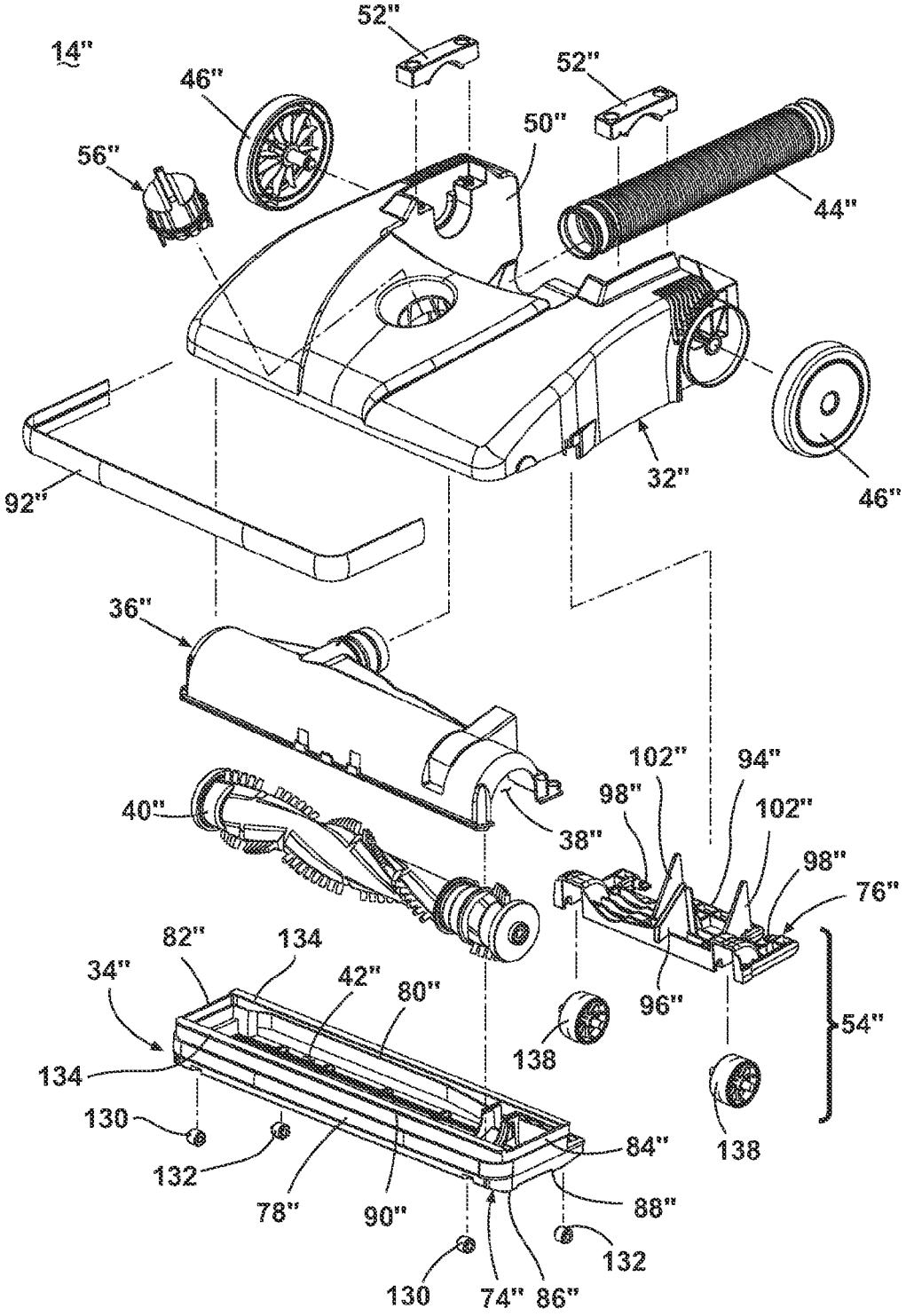
FIG. 11 is an exploded view of a base assembly of a vacuum cleaner according to a third embodiment of the invention.

FIG. 11 is an exploded view of a base assembly 14" of a vacuum cleaner according to a third embodiment of the invention, where features in common with the first embodiment shown in FIGS. 1-9 are indicated with the same reference numeral bearing a double prime (") symbol. The base assembly 14" can be used on the vacuum cleaner 10 shown in FIG. 1 in place of the base assembly 14. The third embodiment differs from the first embodiment in that the sole plate 34" is formed as a separate, independently-movable body from the agitator height control mechanism 54" for selectively adjusting the vertical height of the agitator 40" relative to the surface to be cleaned. Like the first embodiment, the sole plate 34" mates with the agitator casing 36" to create the agitator chamber 38". The suction nozzle opening 42" is formed in the sole plate 34" in fluid communication with the agitator chamber 38" and the duct 44", such that the suction nozzle opening 42" is in fluid communication with collection system 18 (FIG. 1). As will be described below, the control mechanism 54" adjusts the position of the upper housing 32" and agitator casing 36" relative to the sole plate 34", which, by virtue of the agitator 40" being mounted within the agitator casing 36", results in an adjustment of the position of the agitator 40" relative to the suction nozzle opening 42". The sole plate 34" remains essentially stationary throughout the adjustment such that the distance between the suction nozzle opening 42" and the surface to be cleaned is the same regardless of the position of the agitator 40". The sole plate 34" is not entirely stationary during operation, in that the sole plate 34" is a "floating" sole plate that is configured to automatically adjust to different floor surface features, carpet pile heights, etc.

The sole plate 34" comprises a body forming the suction inlet 74" that defines the suction nozzle opening 42". The suction inlet 74" comprises front wall 78", rear wall 80", and side walls 82", 84" which together form a sleeve-like inlet that is slidingly received by the agitator casing 36". The suction inlet 74" further includes a bottom leading and trailing walls 86", 88" which can have a slight curvature and/or angle for the sole plate 34" to glide over the surface to be cleaned. As illustrated, both the leading and trailing walls 86", 88" are angled downwardly toward the suction nozzle opening 42" (see FIG. 12). Two forward wheels 130 are coupled to the leading wall 86" and two rearward wheels 132 are coupled to the trailing wall 88".

Figure 12:
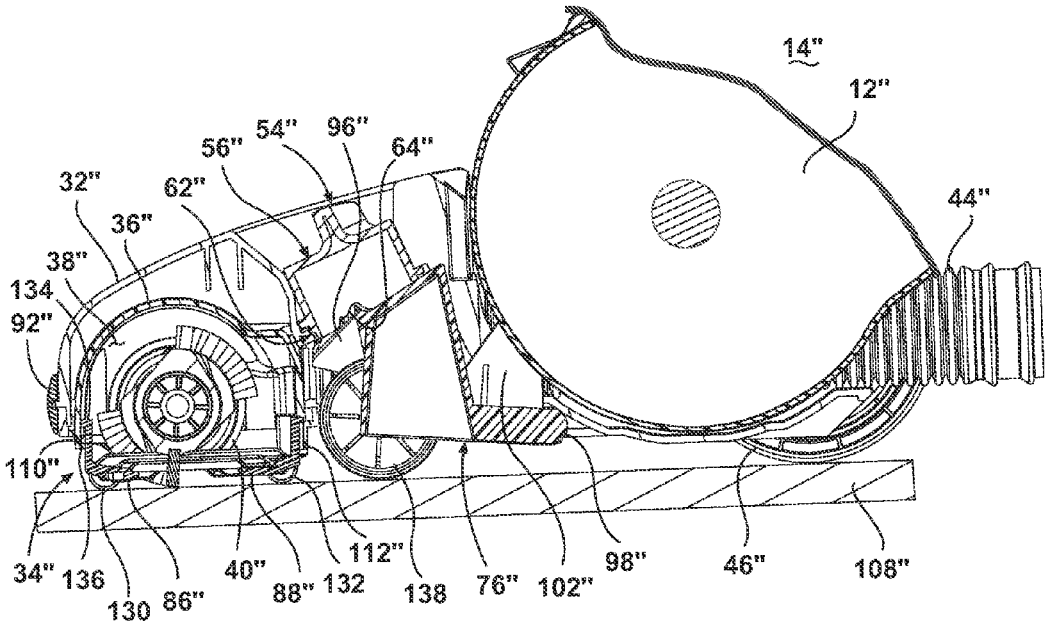
FIG. 12 is a cross-sectional view through line 12-12 of FIG. 11, illustrating an agitator of the base assembly in a lowered position with respect to a floor surface.

The sole plate 34" can be slidably mounted within the agitator casing 36" or upper housing 32" for vertical movement relative thereto. As shown in FIG. 12, the vertical walls 78", 80", 82", 84" of the sole plate 34" can slidingly engage corresponding vertical walls that protrude downwardly from the upper housing 32". In the illustrated embodiment, the walls 78"-82" engage the walls of the agitator chamber 36". The at least one of the walls 78"-82" on the sole plate 34" can include hooks 134 for selectively engaging a stop 136 on the walls of the agitator chamber 36" to retain the sole plate 34" within the upper housing 32" when the upper housing 32" is raised to a maximum position away from the surface to be cleaned. As shown, the front and rear walls 78", 80" comprise hooks 134 and the front and rear walls 110", 112" of the agitator casing 36" comprise stops 136. The movement of the sole plate 34" can be constrained between minimum and maximum positioned based on the mounting configuration of the sole plate 34" within the agitator casing 36" or upper housing 32".

The control mechanism 54" comprises the carriage assembly 76" and the user-operated actuator 56" that engages the carriage assembly 76". The carriage assembly 76" is substantially similar to the carriage assembly shown in the first embodiment, which the exceptions that the carriage body 94" is separate from the sole plate 34" and the pivot axles 98" extend toward each other rather than away from each other. The carriage assembly 76" also has a dedicated set of wheels 138.

Figure 13:
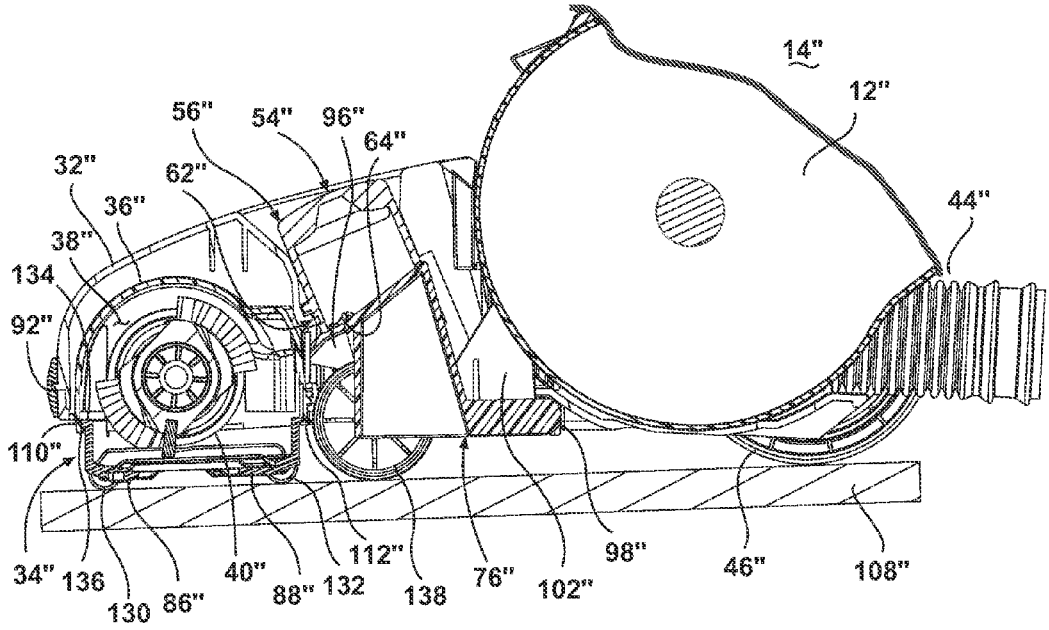
FIG. 13 is a cross-sectional view similar to FIG. 12, illustrating the agitator in a raised position with respect to a floor surface.

FIGS. 12 and 13 are cross-sectional views through a midline of the base assembly 14" of FIG. 1, illustrating the agitator 40" in a lowered position and a raised position, respectively, with respect to a floor surface 108". Also, the upright handle assembly 12" is illustrated in a lowered use position in both FIGS. 12 and 13. In the lowered position of FIG. 12, the agitator 40" is fully engaged with the floor surface 108". In the raised position of FIG. 13, the agitator 40" is fully raised or disengaged from the floor surface 108". The engagement of the agitator 40" with the floor surface 108" can be adjusted by rotating the actuator 56" in a clockwise or counterclockwise direction. As the actuator 56" is rotated, the cam follower 96" riding along the cam portion 62" on the actuator 56" moves between the incremental steps 64" of the cam portion 62", which adjusts the vertical position of the front portion of the upper housing 32" relative to the wheels 138 of the carriage assembly 76", which remain on the floor surface 108". The pivot axles 98" act as a fulcrum about which the upper housing 32" moves. Since the vertical position of the agitator 40" is fixed relative to the upper housing 32", the height of the agitator 40" is adjusted up or down, depending on the direction of actuator rotation, from a fully lowered position shown in FIG. 12 where the agitator 40" is close to the floor surface 108", to a fully raised position shown in FIG. 13 where the agitator 40" is further from the floor surface 108". While only two agitator positions are illustrated herein, it is understood that any number of discrete agitator positions are possible, and are dependent on the number of incremental steps 64" provided on the actuator 56".

In the raised and lowered positions, the vertical position of the sole plate 34" does not change, and the distance between the floor surface 108" and the suction nozzle inlet 42" remains constant. The suction nozzle opening 42" therefore remains essentially parallel with the floor surface 108". The wheels 130, 132 of the sole plate 34" will continue to rest on the floor surface 108" while the upper housing 32" is lifted or lowered because the sole plate 34" is slidably mounted relative to the upper housing 32". The primary change is in the position of the suction inlet 74" relative to the upper housing 32" or agitator 40". As such, there is no loss of suction when adjusting the amount of engagement between the agitator 40" and the floor surface 108". This also allows proper suction to be maintained at the suction nozzle inlet 42", even if the agitator engagement setting is not set to the optimal position for the specific type of floor surface 108". Furthermore, since the sole plate 34" is separate from the agitator height control mechanism 54", the sole plate 34" can freely move up and down, or float, along the floor surface 108" during operation, thereby permitting the sole plate 34" to automatically adjust to the type of floor surface 108" below the base assembly 14", such as carpet, including different carpet pile heights, or bare floor. The overlapping walls of the suction inlet 74" and the agitator casing 36" minimize air leakage and thus improves cleaning performance. While shown herein as being relatively straight, overlapping walls of the suction inlet 74" and the agitator casing 36" can be can be curved or slightly arcuate to help minimize air leakage, as disclosed above for the first embodiment. For example, the front and rear walls 78", 80" can be curved or slightly arcuate and the corresponding front and rear walls 110", 112" of the agitator casing 36" can have a complementary curve. Furthermore, one or both of the sole plate 34" and the agitator casing 36" can be provided with a recess for receiving one or more wall of the other, as described above for the first embodiment with respect to FIG. 9.

In this embodiment or any of the previous embodiments, the overlapping wall structure of the sole plate 34" to upper housing 32" interface can include a seal therebetween configured to help minimize or eliminate air leakage while still permitting movement of the sole plate 34" relative to the upper housing 32". For example, a flapper seal can be positioned between the overlapping walls and on either the sole plate 34" or upper housing 32". Alternatively, the overlapping wall interface can be replaced with a an elastomeric bellows-type sleeve, which will also minimize or eliminate air leakage while still permitting movement of the sole plate 34" relative to the upper housing 32". Furthermore, while not illustrated herein, the second embodiment of the invention can be modified to separate the sole plate 34' from the control mechanism 114 in a similar manner as for the third embodiment.

While the invention has been specifically described in connection with certain specific embodiments thereof, it is to be understood that this is by way of illustration and not of limitation, and the scope of the appended claims should be construed as broadly as the prior art will permit. The illustrated vacuum cleaner is but one example of the variety of vacuum cleaners with which this invention or some slight variant can be used. While shown and described for use with an upright vacuum cleaner, the agitator height control mechanisms 54, 114 can be used with other types of vacuum cleaner, such as "stick"-type upright cleaners, canister vacuum cleaners, robotic vacuum cleaners, hand-held vacuum cleaners, or built-in central vacuum cleaning systems. For example, in a canister vacuum cleaner, the base assembly 14 can be configured as a floor nozzle that is coupled to a canister body via a wand-type handle and a vacuum cleaner hose. The agitator height control mechanism 54, 114 can also be used with vacuum cleaners adapted to dispense and/or take up fluids, such as extractors and steam cleaners. Reasonable variation and modification are possible within the forgoing disclosure and drawings without departing from the scope of the invention which is defined by the appended claims. It should also be noted that all elements of all of the claims may be combined with each other in any possible combination, even if the combinations have not been expressly claimed.

What is claimed is:

1. A vacuum cleaner comprising:

a base assembly adapted for movement along a surface to be cleaned, and having an upper housing comprising an agitator chamber defined by a first peripheral wall extending around at least a portion of the agitator chamber and a working air conduit adapted to be fluidly interconnected with a suction source;

an agitator mounted within the agitator chamber in fixed position relative to the upper housing;

an agitator height control mechanism for selectively adjusting the position of the upper housing relative to the surface to be cleaned to thereby adjust the vertical height of the agitator relative to the surface to be cleaned; and a sole plate comprising a suction nozzle opening in register with the agitator chamber and a second peripheral wall in alignment with the first peripheral wall, wherein the sole plate is coupled to the upper housing for movement between at least a first position and a second position, wherein, as the position of the upper housing relative to the surface to be cleaned is adjusted, the sole plate moves between at least the first and second positions;

wherein, as the sole plate moves between at least the first and second positions, the first and second peripheral walls remain in alignment with one another.

2. The vacuum cleaner of claim 1, and further comprising a carriage assembly pivotally coupled to the upper housing, wherein the agitator height control mechanism comprises at least one of a cam and a cam follower, the carriage assembly comprises the other of a cam and a cam follower, and actuation of the agitator height control mechanism causes the cam to bear against the cam follower and move the sole plate between the first and second positions.

3. The vacuum cleaner of claim 2, wherein the abutment of the cam against the cam follower determines the vertical position of the upper housing with respect to the sole plate.

4. The vacuum cleaner of claim 2, wherein the sole plate comprises the carriage assembly, such that actuation of the agitator height control mechanism causes the cam to bear against the cam follower and move the sole plate between the first and second positions.

5. The vacuum cleaner of claim 1, wherein actuation of the agitator height control mechanism raises the upper housing upwardly with respect to the sole plate and urges the sole plate against the surface being cleaned.

6. The vacuum cleaner of claim 1, wherein the agitator comprises a longitudinal axis and is rotatably mounted to the base assembly for rotation about the longitudinal axis.

7. The vacuum cleaner of claim 1, wherein at least a portion of one of the first and second peripheral wall is slidingly received within a corresponding recess located with the other of the first and second peripheral wall.

8. The vacuum cleaner of claim 1, wherein the first peripheral wall can comprise at least one first curved wall and the second peripheral wall can comprise at least one corresponding second curved wall in alignment with the at least one first curved wall, wherein as the sole plate moves between at least the first and second positions, the at least one first and second curved walls remain in alignment with one another.

9. The vacuum cleaner of claim 1, wherein the sole plate comprises a leading bottom wall and a trailing bottom wall having at least one of a curved portion and an angled portion for permitting the sole plate to glide over the surface to be cleaned.

10. The vacuum cleaner of claim 1, wherein the sole plate is slidably coupled to the upper housing.

11. The vacuum cleaner of claim 10, wherein the sole plate is further pivotally coupled to the upper housing.

12. The vacuum cleaner of claim 11, wherein the sole plate includes at least one wheel which engages the surface to be cleaned.

13. The vacuum cleaner of claim 10, wherein the sole plate comprises a floating sole plate that automatically adjusts the vertical position of the suction nozzle opening relative to the upper housing to accommodate different floor surfaces.

14. The vacuum cleaner of claim 1, wherein the control mechanism comprises a sensor for generating a signal representative of the surface to be cleaned, a controller for receiving the signal from the sensor, and an actuator in register with a carriage assembly, wherein the controller operates the actuator to position the upper housing with respect to the carriage assembly based on the signal.

15. The vacuum cleaner of claim 14, wherein the sole plate comprises the carriage assembly, such that the controller operates the actuator to position the upper housing with respect to the sole plate based on the signal.

16. The vacuum cleaner of claim 15, wherein the actuator comprises an electromechanical solenoid piston assembly having a piston housing and a movable piston rod that is adapted to reciprocate between extended and retracted positions relative to the piston housing in response to control signals received from the controller.

17. The vacuum cleaner of claim 16, wherein the piston rod is linked to the sole plate via a pin joint such that reciprocating linear movement of the rod pulls and pushes the sole plate.

18. The vacuum cleaner of claim 1, and further comprising an upright handle assembly pivotally mounted to the base assembly, the upright handle assembly comprising a collection system for separating and collecting contaminants from a working airstream, wherein the sole plate comprises at least one projection extending upwardly from the upper surface of the sole plate to engage the upright handle assembly when the upright handle assembly is moved to a storage position, thereby automatically disengaging the agitator from the surface to be cleaned.

* * * * *